US008281712B1

(12) United States Patent
Hoffa

(10) Patent No.: US 8,281,712 B1
(45) Date of Patent: Oct. 9, 2012

(54) TWIST-TIE CATCH TWISTER APPARATUS

(75) Inventor: Jack L. Hoffa, Brea, CA (US)

(73) Assignee: Johnson International Corp., Tustin, CA (US)

( * ) Notice: Subject to any disclaimer, the term of this patent is extended or adjusted under 35 U.S.C. 154(b) by 0 days.

(21) Appl. No.: 13/506,520

(22) Filed: Apr. 25, 2012

(51) Int. Cl.
*B65B 13/28* (2006.01)
*B21F 9/02* (2006.01)
*B21F 15/04* (2006.01)

(52) U.S. Cl. ..... 100/31; 140/93.6; 140/119

(58) Field of Classification Search ..... 100/26, 100/31; 140/57, 93.6, 119, 118
See application file for complete search history.

(56) References Cited

U.S. PATENT DOCUMENTS 3,898,924 A 8/1975 Mead et al.
3,961,450 A * 6/1976 Knaell ..... 451/375
4,117,988 A 10/1978 Moore
4,177,842 A 12/1979 Dilley
4,559,977 A 12/1985 Dilley
4,655,264 A * 4/1987 Dilley ..... 140/93.6
5,217,049 A * 6/1993 Forsyth ..... 140/93.6
5,389,190 A 2/1995 Larsen et al.
5,613,530 A 3/1997 Contreras et al.
5,836,137 A 11/1998 Contreras et al.
5,916,108 A * 6/1999 Drietz et al. ..... 53/370

* cited by examiner

*Primary Examiner* — Jimmy T Nguyen
(74) *Attorney, Agent, or Firm* — Gordon K. Anderson

(57) ABSTRACT

A twist-tie catch twister apparatus is taught that consists of dual feed rollers that feed twist-tie material through a back opening in a catch twister into the groove of a peripheral ring, which continues around the ring penetrating the front side of the catch twister through a second opening. The twist-tie material is then retained by a twist-tie clamp and the rollers reverse rotation drawing the twist-tie material onto a workpiece. The catch twist motor rotates the catch twister one half turn twisting to hold tension on the workpiece. A twist-tie cutter, positioned between the feed rollers and split ring, severs the twist-tie material and the twist-tie tape clamp opens with the motor rotating the catch twister a predetermined number of turns and then reverses at least one half turn to release the twisted material and the split ring opens for removal of the twist-tie secured workpiece.

20 Claims, 6 Drawing Sheets

TWIST-TIE CATCH TWISTER APPARATUS

TECHNICAL FIELD

The present invention relates to an apparatus for twisting together ends of twist-tie material to enclose an article in general. More specifically to a twist-tie catch twister that permits twist-tie material to enter the front and back of the twister and be rotated by a motor to coil the twist-tie material around the article in a controlled manner.

BACKGROUND ART

Previously, many types of twist tying machines and apparatus have been used in endeavoring to provide an effective means to close the open end of an outer covering over an article such as bread wrappers, produce products etc.

A search of the prior art did not disclose any patents that possess the novelty of the instant invention; however the following U.S. patents are considered related:

| Pat. Number | Inventor | Issue Date |
|---|---|---|
| 3,898,924 | Mead et al. | Aug. 12, 1975 |
| 4,177,842 | Dilley | Dec. 11, 1979 |
| 4,117,988 | Moore | Oct. 3, 1978 |
| 4,559,977 | Dilley | Dec. 24, 1985 |
| 5,389,190 | Larsen et al. | Feb. 14, 1995 |
| 5,613,530 | Contreras et al. | Mar. 25, 1997 |
| 5,836,137 | Contreras et al. | Nov. 17, 1998 |

Mead et al. in U.S. Pat. No. 3,898,924 teaches an operable hoop shaped tape guide, a first clamp that holds the tape while the slack is taken up and a second clamp holding the tape until it is severed and twisted. The improvement is a rotatably mounted cam which pushes against cam followers on push members and operates clamps as a knife. A series of lobes formed in the surface of the cam displace the push members and fix the time relationship and sequence of the events.

U.S. Pat. No. 4,177,842 issued to Dilley is for improved clamps having clamping strokes of a prescribed dimension actuated by air pressure, such that the strokes are terminated only when the clamping rods actually abut. Thus wear or looseness does not adversely affect function of the clamping rods.

Moore in U.S. Pat. No. 4,117,988 discloses an adapter having a tubular center section and a pair of circular flange sections at each end of the tubular center section. One of the flanges is movable to insert or release the tie tape. The tube is segmented circumferentially and expands to engage the coil of tie tape.

Dilley in U.S. Pat. No. 4,559,977 teaches tie material encircling produce fed by pressure rollers forming a complete loop. A first gripper clamps the material between a second gripper. The pressure rollers reverse retracting excess material. A friction clutch allows slippage when tightening. A twister head rotates the material and shearing edges sever the material. Rack and pinion mechanisms rotate the twister head and forward and reverse feeding.

U.S. Pat. No. 5,389,190 issued to Larsen et al. is for an extracting and cutting mechanism with a magnetic application mechanism producing a magnetic force to remove the twist-tie from the extracting and cutting mechanism. A dispensing mechanism dispenses hot melt tape on the twist-tie held by the magnetic application mechanism then applies the twist-tie to a surface of a container.

Contreras et al. in U.S. Pat. No. 5,836,137 discloses a pneumatic drive apparatus having a rotary actuator with a gear and one-way clutch. A control valve energizes the rotation direction and a roller limit valve energizes the control valve to complete the functional operation of encircling, gathering, twisting and cutting tie tape around an article. A pneumatic valve bypasses the manual trigger system in the event of malfunction or jam allowing the device to reset itself into the ready to operate position.

For background purposes and as indicative of the art to which the invention is related reference may be made to the remaining cited U.S. Pat. No. 5,613,530 issued to Contreras et al.

DISCLOSURE OF THE INVENTION

In the past pneumatic, hydraulic and electrical power sources have been utilized in various tying machines with some success however most are complicated, noisy, inefficient in power consumption and limited to a particular tying material.

It is therefore a primary object of the invention to have an apparatus that is simple in construction using only a few required components. This improvement is accomplished using a twist-tie catch twister that receives the twist-tie material on one side permitting the twist-tie material to follow the guide groove in the hinged split ring, and receive the twist-tie material through the reverse side of the twister where the twist-tie material is then clamped on the end. The twist-tie material is then is drawn tightly around the workpiece article by dual feed rollers and the catch twister rotates a half turn holding its grip and the twist-tie material is then severed with a cutter and its distal end is released, the catch twister then finishes the coil around the article a predetermined number of turns. Only six uncomplicated operating components are required in total for the invention.

An important object of the invention is that the program operating the motor rotating the catch twister and motor for the dual feed rollers may be easily programmed to revolve in either direction. In the case a servo motor with a multi line encoder is used the rotational speed and stopping position is achieved allowing precise repeatable operation and adjustments to be made according to the requirements of the article being tied. As an example when the hinged split ring is changed in diameter the feed roller may be simply programmed to change the length of the twist-tie material fed into the ring. The tightness of the tie onto the workpiece and the number of twists per cycle may be programmed by varying the distance the feed rollers reverse the twist-tie material as users of the apparatus often require looser or tighter ties such as 4.0 inches (10.2 cm) in a loose tie with 1½ turns or 1.0 inch (2.45 cm) in a tight tie with 4 turns. If a user is running one larger size workpiece continually, the tape reverse distance may be set for a much smaller distance, saving time and travel.

Another object of the invention is that the combination of components are not operationally sensitive to twist-tie material size or construction which permits almost all commonly used twist-tie material to be used interchangeably. Wire size and the stiffness, or softness, and the numbers of wires embedded in the material including the width and thickness are not a factor, therefore from the smallest to the largest may be used with total impunity. Employing a servo motor coupled with a multi line encoder permits this functional operation in the wide variety of materials or tie material because of its ability to set high speeds along with acceleration/deceleration values of the dual feed rollers.

Still another object of the invention is the quiet operation as, when used, electric motors ramp up smoothly creating little noise. The snap action of the split ring, twist-tie clamp and twist-tie cutter driven by electromagnetic solenoids emit only short subdued noise when energized.

A final object of the invention is the space and cost saving eliminating complicated mechanical arrangements and improving the reliability of the overall assembly.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
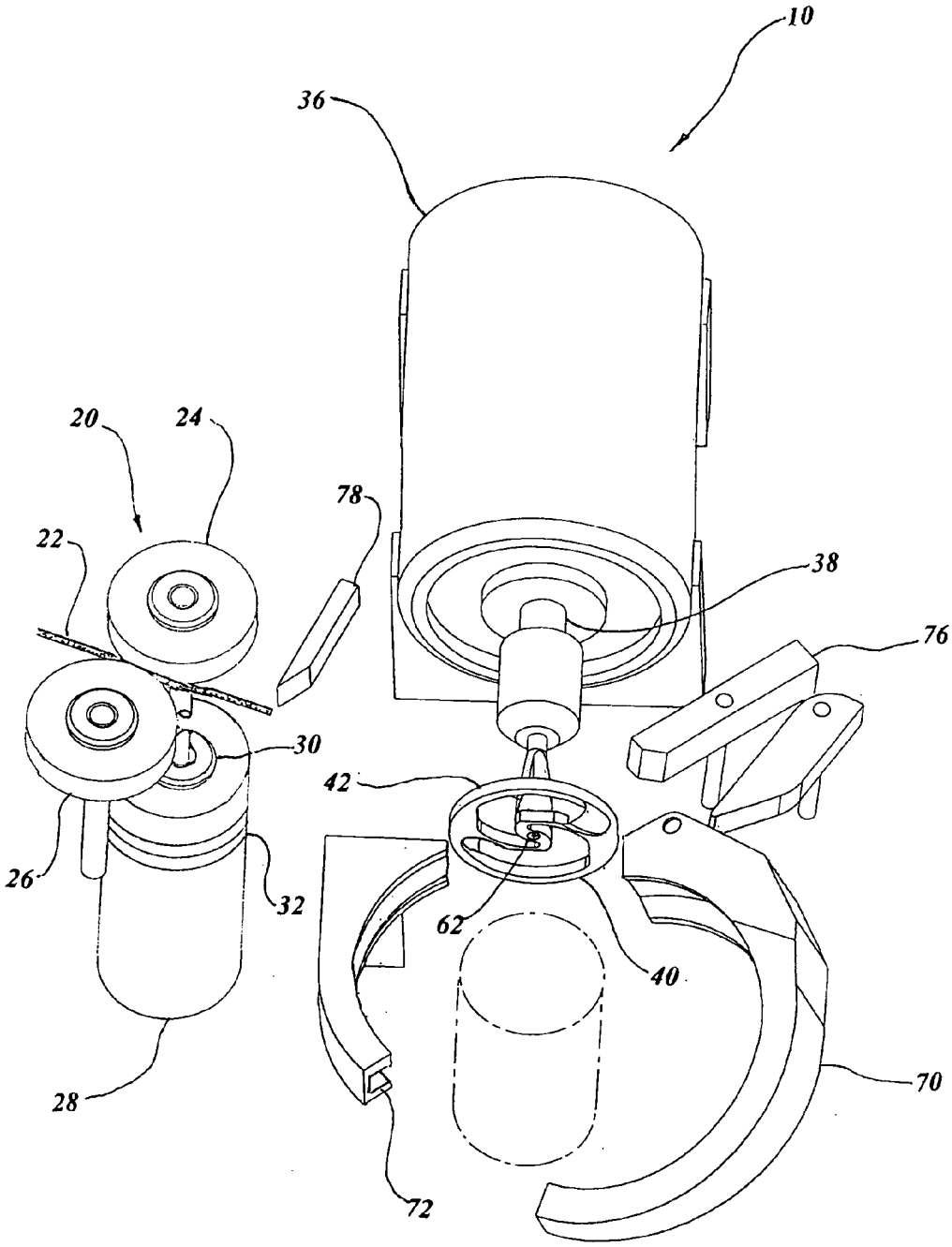
FIG. 1 is a partial isometric view of the twist-tie catch twister apparatus with the split ring open in the preferred embodiment.

The best mode for carrying out the invention is presented in terms of a preferred embodiment. This preferred embodiment is shown in FIGS. 1 through 10 and is comprised of a twist-tie catch twister apparatus 10 for twisting together ends of the tie-wrap enclosing an article, with the article hereafter known as the workpiece.

Dual feed rollers 20 are employed for feeding and reversing twist-tie material 22 that is positioned between the rollers 20. The dual feed rollers 20 consist of a power roller 24 and a follower roller 26 intimately engaged together to transmit twist-tie material 22 in either direction. The power roller 24 is driven by a feed roller motor 28, such as a step motor or preferably by a servo motor with a multi-line encoder energized with an AC or DC current. Alternatively a pneumatic/hydraulic linear to rotary motor may be employed. In any case the motor driving the power roller 24 includes a one-way clutch 30 and a slip-clutch 32, with the power roller 24 incorporating urethane material.

A catch twister 40, illustrated separately in FIGS. 6-10, is in alignment with the dual feed rollers 20 and is configured as a peripheral ring 42 having a front side 44 and a rear side 46. The ring 42 has two identical separate kidney shaped openings 48 inside the ring 42, each opening 48 is transitioned into a hook shape 50 on one end forming a reciprocal oval shaped center 52, illustrated best in FIGS. 9 and 10. Each opening 48 has a tapered tape feeding radial recess 54 on the front side 44 tapered to the periphery and an opposed radial recess 54 on the rear side 46 tapered to the ring periphery. The hook shaped transition 50 permits a final wrapping of twist-tie material 22 a predetermined number of turns around the oval shaped center 52.

The catch twister peripheral ring 42 incorporates a stem 56. The stem 56 has a tapered oval shape 58 that interfaces with the reciprocal oval shaped center 52, on one end, a round shank 59, and an integral hollow coupling 60 on a distal end.

The stem 56 may be integrally formed with peripheral ring oval shaped center 52, attached with threaded fasteners 62 or joined with a weld bead 64.

The hollow coupling 60 may include a setscrew 66 or a setscrew 66 with a keyway 68 beneath for motor shaft attachment.

The catch twister 40 preferably has an outside diameter at least 1.50 inches (3.8 cm), or if larger, the scale of the peripheral ring 42 to the openings 48 and 50 and the center 52 are all proportional.

The catch twister 40 may be formed aluminum, steel, thermoplastic resin or fiber reinforced polymer.

A catch twist motor 36 with a drive shaft 38 attaches to the hollow coupling 60 and rotates the catch twister 40. The catch twist motor 36 may be any type suitable for the application, preferably by a servo motor with a multi-line encoder or a step motor utilizing an electrical AC or DC current. Alternatively a pneumatic/hydraulic linear to rotary motor may also be employed.

A radial hinged split ring 70, having a guide groove therein 72, is positioned adjacent to the catch twister 40 and is capable of opening for entry of a workpiece 74. The radial hinged split ring 70 has an inside diameter sized to accommodate an intended workpiece 74 which could be any dimension. In the industry the common sizes are essentially 4 inches (10 cm), 6 inches (15 cm), and 8 inches (20 cm) however any diameter could be used with equal ease.

A twist-tie clamp 76, positioned adjacent to the split ring 70, grasps and retains twist-tie material 22 leaving the catch twister rear side 46. The twist-tie clamp 76 operated with any suitable actuator, well known in the art, such as an electromagnetic solenoid.

A twist-tie cutter 78 is positioned between the feed rollers 20 and the split ring 70 and severs the twist-tie material 22 prior to the split ring opening for removal of the twist-tie secured workpiece 74. The cutter 78 is also operated with any suitable actuator, including an electromagnetic solenoid.

The twist-tie catch twister apparatus 10 operates with a myriad of different twist-tie materials 22 which include, but not limited to, a plastic material, a paper material, a paper/plastic material, a one wire material, a two wire material, a 24 gage wire, a 27 gage wire, a 5/32 inch (4 mm) width, a 1/4 inch width, (6.4 mm), and a 1/2 inch (12.7 mm) width.

The twist-tie catch twister apparatus 10 is illustrated in the drawings with is function depicted as follows:

FIG. 1 illustrates that a Twist-tie material 22 is introduced between the dual feed rollers 20 and a workpiece 74 is placed within the open split ring 70.

Figure 2:
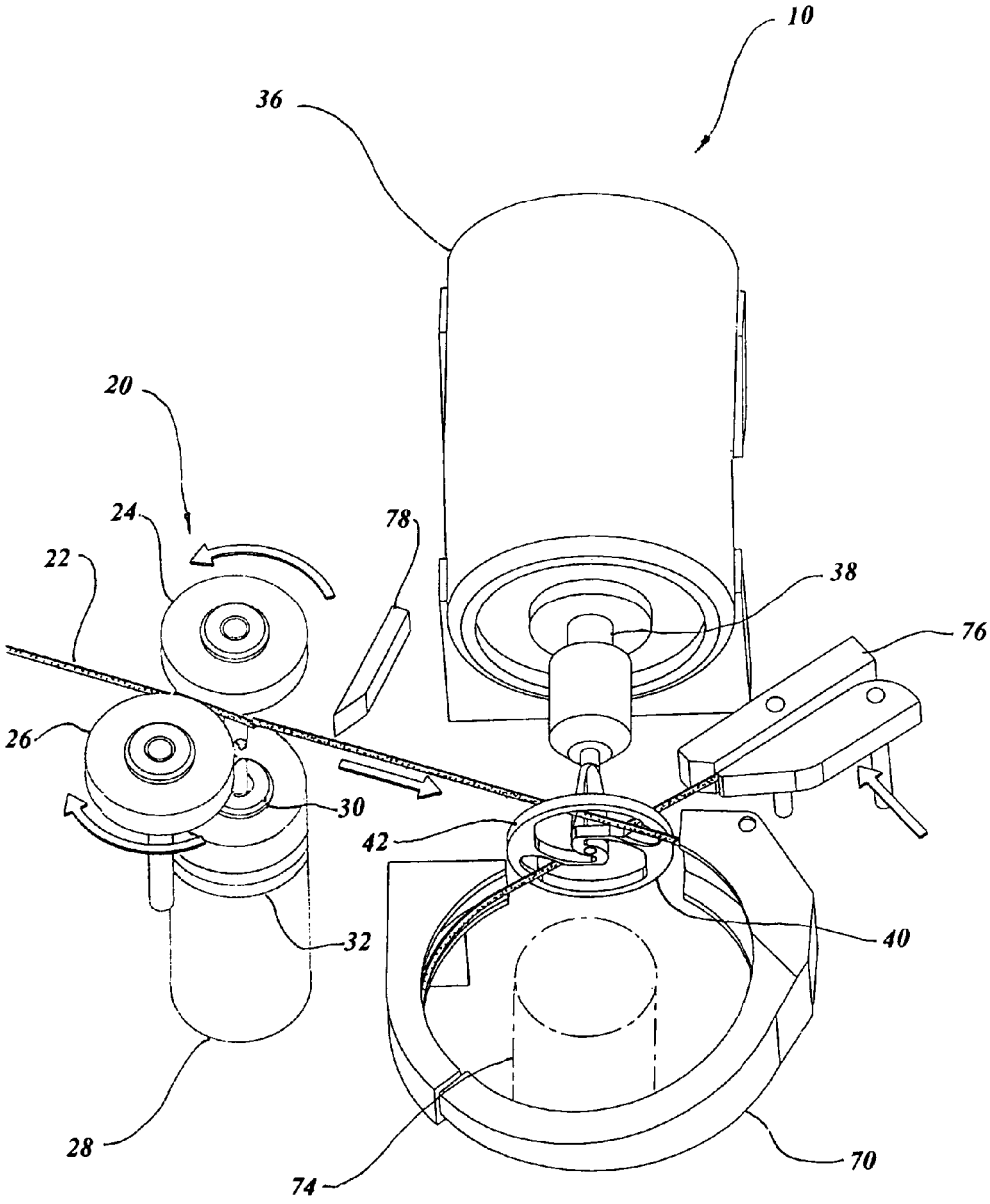
FIG. 2 is a partial isometric view of the twist-tie catch twister apparatus with the split ring closed and the twist-tie material entering the ring and grasped by the twist-tie clamp, in the preferred embodiment.

FIG. 2 depicts the split ring 70 closed around the workpiece 74 and the twist-tie material 22 fed from the feed rollers 20 into the rear side 46 of the upper one of the kidney shaped openings 48 in the catch twister 40, guided by the opposed tapered twist-tie feeding radial recess 54. The twist-tie material 22 then enters the guide groove 72 in the split ring 70 and continues around the ring 70 and penetrates the front side 44 of the catch twister 40 through the remaining kidney shaped openings 48, guided by the openings twist-tie feeding radial recess 54. The twist-tie material 22 continues into the twist-tie clamp 76 where it is captured.

Figure 3:
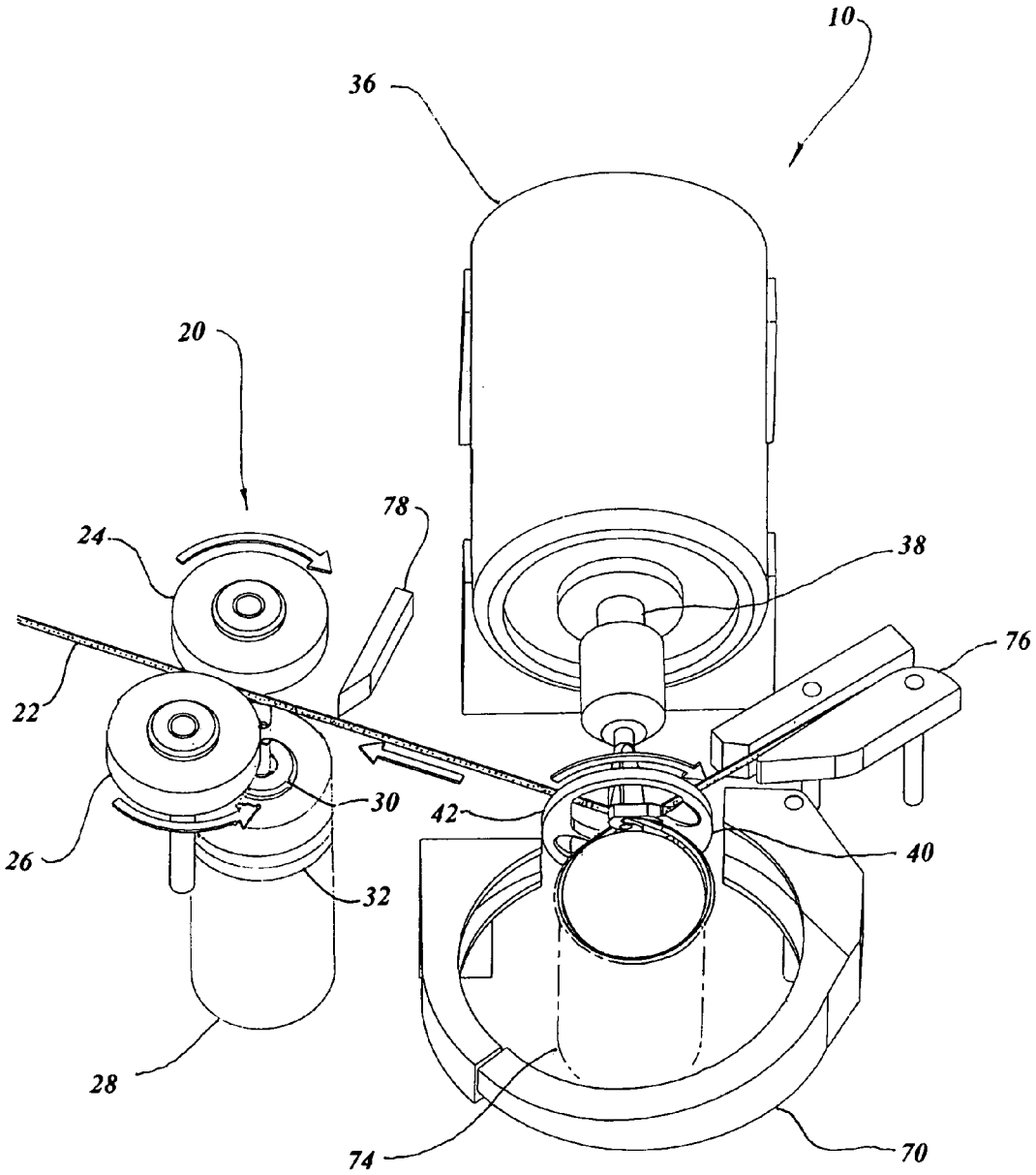
FIG. 3 is a partial isometric view of the twist-tie catch twister apparatus with the split ring closed and the twist-tie material gathered around the workpiece in the preferred embodiment.

FIG. 3 shows that the feed rollers 20 reverse direction and draw twist-tie material 22 onto a workpiece 74. The catch twister motor 36 rotates the catch twister 40 essentially one half turn twisting sufficiently to hold tension on the workpiece 74.

Figure 4:
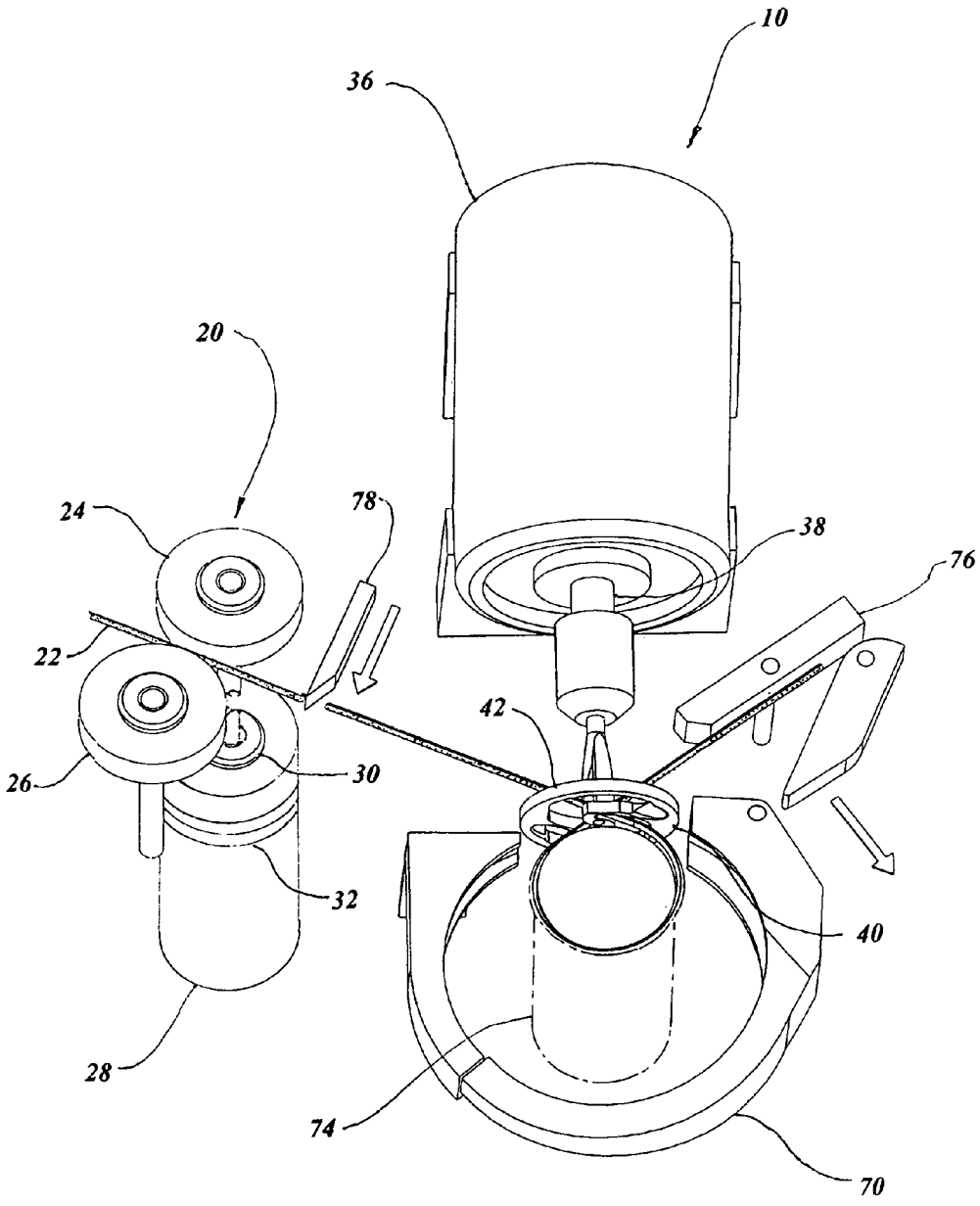
FIG. 4 is a partial isometric view of the twist-tie catch twister apparatus with the split ring closed and the twist-tie material rotated one half turn, severed by the cutter and released by the clamp, in the preferred embodiment.

FIG. 4 represents the function of severing the twist-tie material 22 by the twist-tie cutter 78 with the half turn twist retaining the tension on the workpiece 74 and the twist-tie clamp 76 opening to release the first end of the twist-tie material 22.

Figure 5:
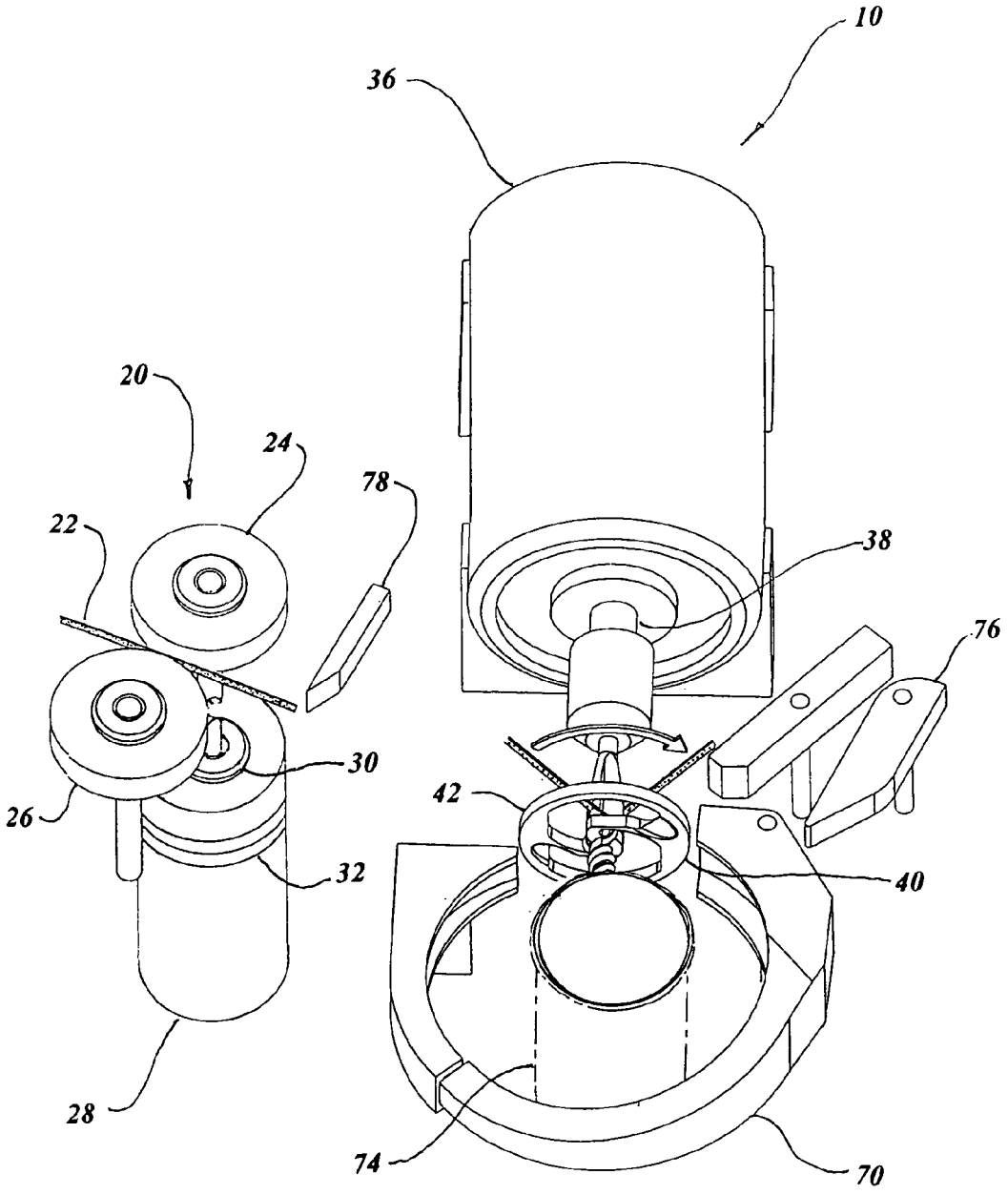
FIG. 5 is a partial isometric view of the twist-tie catch twister apparatus with the split ring closed and the catch twister rotating the twist-tie material a predetermined number of turns ready for release when the split ring is opened.
Figure 6:
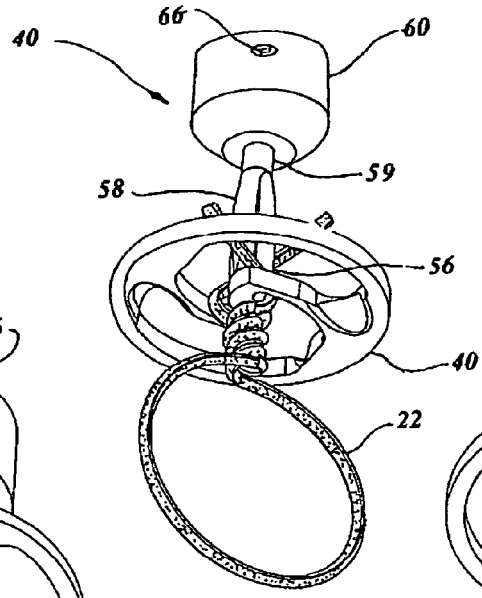
FIG. 6 is a partial isometric view of the catch twister removed from the apparatus with the twist-tie completely coiled ready for removal.
Figure 7:
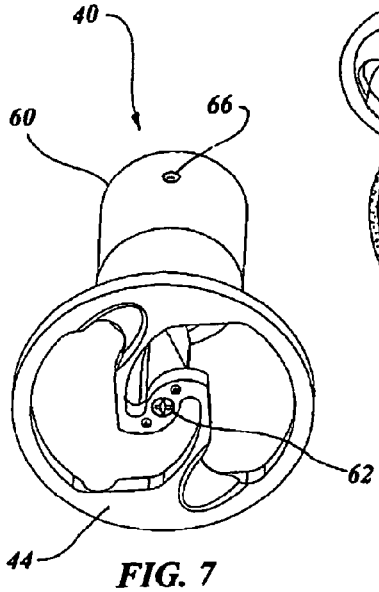
FIG. 7 is a partial isometric front view of the catch twister illustrated separated from the apparatus for clarity.
Figure 8:
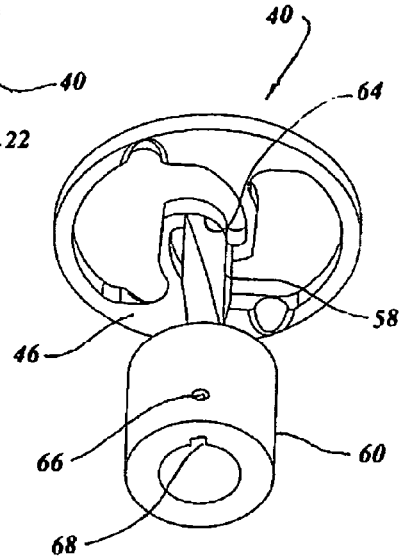
FIG. 8 is a partial isometric rear view of the catch twister illustrated separated from the apparatus for clarity.
Figure 9:
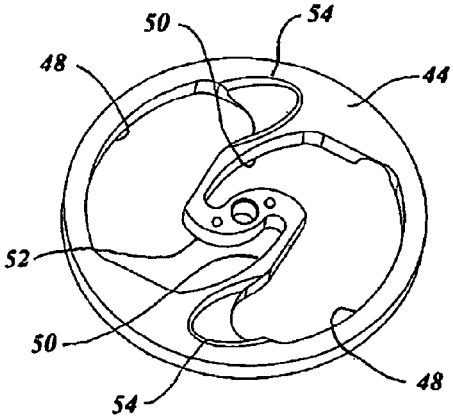
FIG. 9 is a partial isometric front view of the catch twister peripheral ring illustrated separated from the stem and coupling for clarity.
Figure 10:
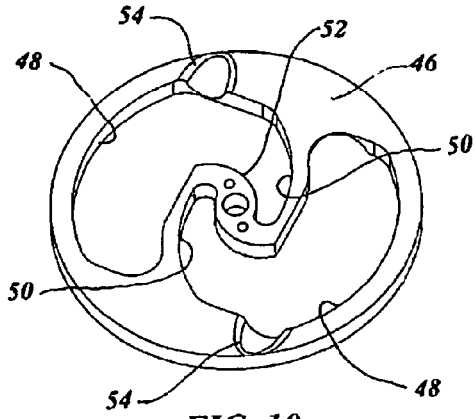
FIG. 10 is a partial isometric rear view of the catch twister peripheral ring illustrated separated from the stem and coupling for clarity.

FIG. 5 illustrates the catch twist motor 36 rotating the catch twister 40 a predetermined number of turns and then reverses at least one half turn to release the twisted twist-tie 22 and the split ring 70 opens for removal of the twist-tie secured workpiece 74.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A twist-tie catch twister apparatus for twisting together ends of a twist-tie enclosing an article which comprises;

a catch twister, aligned with dual feed rollers, with the catch twister having a peripheral ring with a front side and a rear side with the ring having two identical separate kidney shaped openings within the ring each opening transitioned into a hook shape on one end forming a reciprocal oval shaped center, with each opening having a tapered twist-tie feeding radial recess on the front side tapered to the ring periphery and an opposed radial recess on the ring rear side tapered to the ring periphery, the catch twister peripheral ring having a stem with a tapered oval shape interfacing with the reciprocal oval shaped center, also the stem having an integral hollow coupling, a motor with a drive shaft, attached to, and rotating the catch twister, a hinged split ring is closed and a twist-tie material is introduced from the feed rollers into the rear side of one of openings in the catch twister, the twist-tie material enters a guide groove in the split ring and continues around the ring penetrating the front side of the catch twister through one of the openings, a twist-tie clamp, adjacent to the split ring grasps twist-tie material leaving the catch twister rear side, wherein the feed rollers reverse direction and draw the twist-tie material onto a workpiece when the motor rotates the catch twister essentially one half turn twisting sufficiently to hold tension on the workpiece, and a twist-tie cutter, positioned between the feed rollers and split ring, severs the twist-tie material and the twist-tie clamp opens with the motor rotating the catch twister a predetermined number of turns and then reverses at least one half turn to release the twisted material and the split ring opened for removal of the twist-tie secured workpiece.

2. A twist-tie catch twister apparatus for twisting together ends of a twist-tie enclosing an article which comprises;

dual feed rollers feed and reverse a twist-tie tape that is positioned therebetween, a catch twister, aligned with the dual feed rollers, the twister having a front side and a rear side forming a ring, the ring having two identical separate kidney shaped openings, each opening transitioned into a hook shape on one end forming an oval shaped center therebetween, with each opening having a radial recess on the front side tapered to the ring periphery and an opposed radial recess on the ring rear side, also the ring having a stem with a coupling on a distal end, a motor attached to the catch twister, a radial hinged split ring having, a guide groove therein, is positioned adjacent to the catch twister, such that when the ring is closed and twist-tie material is introduced from the feed rollers into the rear side of one of openings in the catch twister, the twist-tie material enters the guide groove and continues around the ring penetrating the front side of the catch twister through one of the openings, a twist-tie clamp, adjacent to the split ring grasps twist-tie material leaving the catch twister rear side, wherein the feed rollers reverse direction and draw the twist-tie material onto a workpiece when the motor rotates the catch twister essentially one half turn twisting sufficiently to hold tension on the workpiece, and a twist-tie cutter, positioned between the feed rollers and split ring, severs the twist-tie material and the twist-tie clamp opens with the motor rotating the catch twister a predetermined number of turns and then reverses at least one half turn to release the twisted material and the split ring opened for removal of the twist-tie secured workpiece.

3. A twist-tie catch twister apparatus for twisting together ends of a twist-tie enclosing an article which comprises;

dual feed rollers feed and reverse a twist-tie material that is positioned therebetween, a catch twister aligned with the dual feed rollers and the catch twister comprising, a peripheral ring having a front side and a rear side with the ring having two identical separate kidney shaped openings within the ring, each opening transitioned into a hook shape on one end forming a reciprocal oval shaped center, with each opening having a tapered twist-tie feeding radial recess on the ring front side tapered to the ring periphery and an opposed radial recess on the ring rear side tapered to the ring periphery, the catch twister peripheral ring further having a stem with a tapered oval shape interfacing with the reciprocal oval shaped center, the stem having an integral hollow coupling on a distal end, a motor having a drive shaft, wherein the shaft is configured to attach to and rotate said catch twister, a radial hinged split ring having, a guide groove therein, positioned adjacent to said catch twister said split ring having provisions to be opened for entry of a workpiece, such that when said ring is closed and twist-tie material is introduced from said feed rollers into the rear side of one of said kidney shaped openings in said catch twister, guided by said opposed radial recess, said twist-tie material enters the guide groove in the split ring and continues around the ring penetrating the front side of said catch twister through said remaining kidney shaped opening, guided by said twist-tie feeding radial recess, a twist-tie clamp, adjacent to said split ring grasps and retains twist-tie material leaving said catch twister rear side, wherein said feed rollers reverse direction and draw twist-tie material onto a workpiece when said motor rotates said catch twister essentially one half turn twisting sufficiently to hold tension on the workpiece, and a twist-tie cutter, positioned between said feed rollers and said split ring, severs the twist-tie material and said twist-tie clamp opens with said motor rotating said catch twister a predetermined number of turns and then reverses at least one half turn to release twisted material and said split ring opened for removal of the twist-tie secured workpiece.

4. The twist-tie catch twister apparatus for twisting together ends of a twist-tie as recited in claim 3 wherein said dual feed rollers further comprise a power roller and a follower roller intimately engaged together to transmit twist-tie material twist-tie therebetween.

5. The twist-tie catch twister apparatus for twisting together ends of a twist-tie as recited in claim 4 wherein said power roller is driven by a roller motor having a slip-clutch and a one-way clutch.

6. The twist-tie catch twister apparatus for twisting together ends of a twist-tie as recited in claim 3 wherein said power roller incorporates a urethane material.

7. The twist-tie catch twister apparatus for twisting together ends of a twist-tie as recited in claim 3 wherein said catch twister further having said stem integrally formed with said peripheral ring oval shaped center.

8. The twist-tie catch twister apparatus for twisting together ends of a twist-tie as recited in claim 3 wherein said catch twister stem is attached to said peripheral ring oval shaped center with threaded fasteners.

9. The twist-tie catch twister apparatus for twisting together ends of a twist-tie as recited in claim 3 wherein said catch twister stem is attached with a weld bead to said peripheral ring oval shaped center.

10. The twist-tie catch twister apparatus for twisting together ends of a twist-tie as recited in claim 3 wherein said hollow coupling further having a setscrew and/or a keyway therein for motor shaft attachment.

11. The twist-tie catch twister apparatus for twisting together ends of a twist-tie as recited in claim 3 wherein said stem having a tapered oval shape interfacing with the oval shaped center, further comprises a round shank integral with the hollow coupling.

12. The twist-tie catch twister apparatus for twisting together ends of twist-tie as recited in claim 3 wherein said separate kidney shaped openings with hook shaped transition permit a final wrapping of said twist-tie material within said hook shaped transitions a predetermined number of turns around the oval shaped center.

13. The twist-tie catch twister apparatus for twisting together ends of a twist-tie as recited in claim 3 wherein said catch twister further having an outside diameter at least 1.50 inches (3.8 cm) and, if larger, the scale of said peripheral ring to said openings and said center are all proportional.

14. The twist-tie catch twister apparatus for twisting together ends of a twist-tie as recited in claim 3 wherein said catch twister is formed of a material selected from the group consisting of aluminum, steel, thermoplastic resin and fiber reinforced polymer.

15. The twist-tie catch twister apparatus for twisting together ends of tie—a twist-tie as recited in claim 3 wherein said motor is selected from the group consisting of, a servo motor with a multi-line encoder, a step motor, a pneumatic linear to rotary motor and a hydraulic linear to rotary motor.

16. The twist-tie catch twister apparatus for twisting together ends of a twist-tie as recited in claim 15 wherein said servo motor with a multi-line encoder and said a step motor operate on power selected from the group consisting of alternating current (AC) and direct current (DC).

17. The twist-tie catch twister apparatus for twisting together ends of a twist-tie as recited in claim 3 wherein said radial hinged split ring has an inside diameter selected from the group consisting of essentially 4 inches (10 cm), essentially 6 inches (15 cm), and essentially 8 inches (20 cm).

18. The twist-tie catch twister apparatus for twisting together ends of a twist-tie as recited in claim 3 wherein said tape clamp further comprises an electromagnetic solenoid for actuation.

19. The twist-tie catch twister apparatus for twisting together ends of a twist-tie as recited in claim 3 wherein said cutter further comprises an electromagnetic solenoid for actuation.

20. The twist-tie catch twister apparatus for twisting together ends of a twist-tie as recited in claim 3 wherein said tape catch twister apparatus is configured to operate with twist-tie material selected from the group consisting of a plastic material, a paper material, a paper/plastic material, a one wire, a two wire, a 24 gage wire, a 27 gage wire, a 5/32 inch (4 mm) width a ¼ inch width, (6.4 mm), and a ½ inch (12.7 mm) width.

* * * * *